US006970672B2

(12) United States Patent
MacMillan et al.

(10) Patent No.: US 6,970,672 B2
(45) Date of Patent: Nov. 29, 2005

(54) ELECTROPHOTOGRAPHIC TONER REGULATING MEMBER WITH POLYMER COATING HAVING SURFACE ROUGHNESS MODIFIED BY FINE PARTICLES

(75) Inventors: David Starling MacMillan, Winchester, KY (US); Vernon Wayne Ulrich, Versailles, KY (US); Jarrett C. Gayne, Lexington, KY (US); Scott Richard Castle, Lexington, KY (US); Ligia Aura Bejat, Versailles, KY (US); Ronald Lloyd Roe, Lexington, KY (US); Bhaskar Gopalanarayanan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 22 days.

(21) Appl. No.: 10/809,123

(22) Filed: Mar. 25, 2004

(65) Prior Publication Data

US 2005/0214033 A1 Sep. 29, 2005

(51) Int. Cl.[7] ..... G03G 15/08
(52) U.S. Cl. ..... 399/284
(58) Field of Search ..... 399/50, 53, 58, 399/66, 106, 111–120, 128, 179, 222–228, 399/239, 252, 253, 258, 262, 265, 279, 281, 399/284

(56) References Cited

U.S. PATENT DOCUMENTS 4,395,110 A 7/1983 Hosono et al.
4,940,643 A * 7/1990 Sakai et al. ..... 430/108.3
4,943,509 A * 7/1990 Sakai et al. ..... 430/138
5,481,343 A 1/1996 Bhagat
5,519,471 A * 5/1996 Nishimura et al. ..... 399/284
5,570,166 A 10/1996 Ohzeki et al.
5,853,868 A 12/1998 Bracken et al.
5,862,444 A 1/1999 Machida et al.
5,897,246 A 4/1999 Yamashita
5,942,364 A * 8/1999 Anno et al. ..... 430/111.35
5,997,772 A * 12/1999 Cornelius et al. ..... 252/507
6,049,689 A 4/2000 Ishii et al.
6,058,284 A * 5/2000 Okano et al. ..... 399/159
6,169,869 B1 * 1/2001 Inami et al. ..... 399/159
6,212,348 B1 * 4/2001 Inoue et al. ..... 399/284
6,229,979 B1 * 5/2001 Ishii et al. ..... 399/281
6,253,052 B1 * 6/2001 Cornelius et al. ..... 399/274
6,301,461 B1 * 10/2001 Sirejacob ..... 399/274
6,339,686 B2 1/2002 Yamanaka et al.
6,341,206 B1 * 1/2002 Yamaguchi et al. ..... 399/103
6,346,356 B1 * 2/2002 Ohno et al. ..... 430/106.2
6,360,069 B1 3/2002 Mimura et al.

(Continued)

*Primary Examiner*—Diego Gutierrez
*Assistant Examiner*—Dixomara Vargas
(74) *Attorney, Agent, or Firm*—Coats & Bennett, PLLC

(57) ABSTRACT

A toner layer regulating system for an electrophotographic image forming apparatus includes a toner carrier; a toner regulating member supported in cantilevered fashion against the toner carrier so as to form a toner nip therebetween comprising a flexible metallic substrate having a coating covering at least an area forming the nip; wherein the coating comprises at least a matrix of a base polymer and a plurality of fine particles having a particle size of 0.1 microns to thirty microns; wherein the coating has a thickness of approximately one hundred fifty microns or less; wherein the coating has a surface roughness in the range of 0.15 to 1.5 microns Ra and in the range of 1 to 15 microns Rz. A carrier stratum may be disposed between the coating and the substrate, and the coating may be single layer or have a plurality of layers.

45 Claims, 8 Drawing Sheets

U.S. PATENT DOCUMENTS

| | | | | |
|---|---|---|---|---|
| 6,466,760 | B2 | 10/2002 | Mizuno | |
| 6,473,587 | B2 * | 10/2002 | van Woerkens | 399/284 |
| 6,606,474 | B2 * | 8/2003 | Sirejacob | 399/274 |
| 6,751,423 | B2 * | 6/2004 | Sakaizawa et al. | 399/55 |
| 2002/0041777 | A1 | 4/2002 | Sirejacob | |
| 2002/0197086 | A1 | 12/2002 | Ishibashi et al. | |
| 2003/0194250 | A1 * | 10/2003 | Ishigaki | 399/279 |
| 2003/0223783 | A1 * | 12/2003 | Yamamoto et al. | 399/284 |
| 2005/0026055 | A1 * | 2/2005 | Moriki et al. | 430/45 |

* cited by examiner

| Material | Parts | Supplier | Location |
|---|---|---|---|
| Adhesive CL-688 Adcote (polyester resin) | 52.61 | Rohm and Haas | Philadelphia, PA |
| Dioxane 1.4 | 10.53 | EMD Chemicals | Gibbstown, NJ |
| Yelkins TS | 1.05 | Univar US | Harrisburg, PA |
| Aerosol OT 100% | 0.52 | Vopak USA | Houston, TX |
| Toluene | 1.72 | Alfa Aesar | Ward Hill, MA |
| Grit NGC 8000 Nanko (silicon carbide) | 23.73 | National Gypsum Co. | Charlotte, NC |
| Black Pearls 2000 (carbon black) | 2.56 | Cabot Corp. | Billerica, MA |
| Z Moly powder | 6.09 | Dow Corning | Midland, MI |
| CoReactant F | 1.18 | Rohm and Haas | Philadelphia, PA |
| Metacure T-12 | 0.01 | Air Products | Rochester, NY |
| *Total Parts* | *100* | | |

*FIG. 7*

ELECTROPHOTOGRAPHIC TONER REGULATING MEMBER WITH POLYMER COATING HAVING SURFACE ROUGHNESS MODIFIED BY FINE PARTICLES

BACKGROUND OF THE INVENTION

The present invention is directed generally to the field of electrophotographic printing, and more particularly to a toner regulating member with a coating on a flexible metallic substrate.

One step in the electrophotographic printing process typically involves providing a relatively uniform layer of toner on a toner carrier, such as a developer roller, that in turn supplies that toner to photoconductive element to develop a latent image thereon. Typically, it is advantageous if the toner layer has a uniform thickness and a uniform charge level. As is known in the art, one common approach to regulating the toner on the toner carrier is to employ a so-called doctor or metering blade. While there have been a number of doctor blade designs proposed in the art, there remains a need for alternative designs that address the special concerns of the electrophotographic development process.

SUMMARY OF THE INVENTION

The present invention, in one embodiment, provides a toner layer regulating system for an electrophotographic image forming apparatus comprising: a toner carrier; a toner regulating member supported in cantilevered fashion against the toner carrier so as to form a toner nip therebetween; the toner regulating member comprising a flexible metallic substrate having a first surface disposed toward the toner carrier and a coating covering at least an area of the first surface forming the nip; wherein the coating comprises at least a matrix of a base polymer and a plurality of fine particles having a particle size of 0.1 microns to 30 microns; and wherein the coating has a thickness of approximately 150 microns or less; wherein the coating has a surface roughness in the range of 0.15 to 1.5 microns Ra and in the range of 1 to 15 microns Rz. The base polymer may be selected from a group consisting of polyurethane, polyester, polyamide, epoxides, phenolics, polyimides, and combinations thereof. The fine particles may be selected from the group consisting of silicon dioxide, titanium dioxide, cerium oxide, silicon carbide, aluminum oxide, titanium diboride, diamond, borosilicate glass, soda glass, enameled glass, polyurethane beads, polyacrylate beads, and silicone beads. The coating may have a dry concentration of the fine particles of between about 1% and about 50% on a weight basis and be formed from a mixture having a wet concentration of the fine particles of between about 1% and about 25% on a weight basis. The coating may further comprise a conductive additive selected from the group consisting of an ionic salt, carbon nanotubes, carbon black, polyanilines, and metallic particles. An optional carrier stratum may be disposed between the coating and the substrate, and may be adhesively secured to the substrate. The coating may be single layer or have a plurality of layers.

In other embodiments, the toner regulating system generally described above may be incorporated into a toner cartridge and/or an image forming device.

BRIEF DESCRIPTION OF THE DRAWINGS

FIG. 7 shows an exemplary coating mixture formulation.

DETAILED DESCRIPTION OF THE INVENTION

As the present invention relates to the regulation of toner in an electro-photographic image forming apparatus, an understanding of the basic elements of an electrophotographic image forming apparatus may aid in understanding the present invention. For purposes of illustration, a four cartridge color laser printer will be described; however one skilled in the art will understand that the present invention is applicable to other types of electrophotographic image forming apparatuses that use one or more toner colors for printing. Further, for simplicity, the discussion below may use the terms "sheet" and/or "paper" to refer to the recording media 5; this term is not limited to paper sheets, and any form of recording media is intended to be encompassed therein, including without limitation, envelopes, transparencies, plastic sheets, postcards, and the like.

Figure 1:
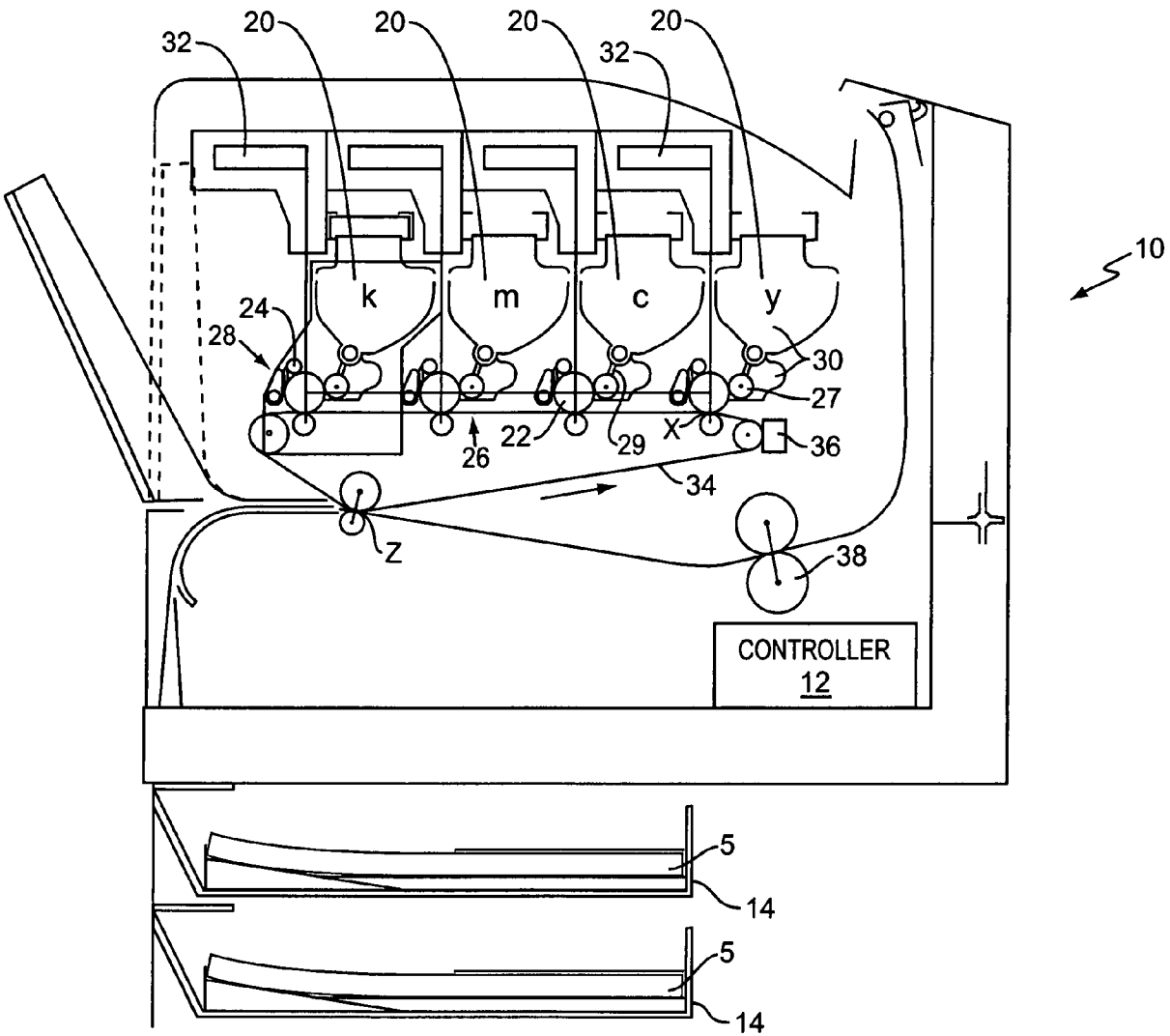
FIG. 1 shows a representation of an image forming apparatus.

A four color laser printer, generally designated 10 in FIG. 1, typically includes a plurality of optionally removable toner cartridges 20 that have different toner color contained therein, an intermediate transfer medium 34, a fuser 38, and one or more recording media supply trays 14. For instance, the printer 10 may include a black (k) cartridge 20, a magenta (m) cartridge 20, a cyan (c) cartridge 20, and a yellow (y) cartridge 20. Typically, each different color toner forms an individual image of a single color that is combined in a layered fashion to create the final multi-colored image, as is well understood in the art. Each of the toner cartridges 20 may be substantially identical; for simplicity only the operation of the cartridge 20 for forming yellow images will be described, it being understood that the other cartridges 20 may work in a similar fashion.

The toner cartridge 20 typically includes a photoconductor 22 (or "photoconductive drum" or simply "PC drum"), a charger 24, a developer section 26, a cleaning assembly 28, and a toner supply bin 30. The photoconductor 22 is generally cylindrically-shaped with a smooth surface for receiving an electrostatic charge over the surface as the photoconductor 22 rotates past charger 24. The photoconductor 22 rotates past a scanning laser 32 directed onto a selective portion of the photoconductor surface forming an electrostatically latent image representative of the image to be printed. Drive gears (not shown) may rotate the photoconductor 22 continuously so as to advance the photoconductor 22 some uniform amount, such as 1/120th or 1/1200th of an inch, between laser scans. This process continues as the entire image pattern is formed on the surface of the photoconductor 22.

After receiving the latent image, the photoconductor 22 rotates to the developer section 26 which has a toner bin 30 for housing the toner and a developer roller 27 for uniformly transferring toner to the photoconductor 22. The toner is typically transferred from the toner bin 30 to the photoconductor 22 through a doctor blade nip formed between the developer roller 27 and the doctor blade 29. The toner is typically a fine powder constructed of plastic granules that are attracted and cling to the areas of the photoconductor 22 that have been discharged by the scanning laser 32. To prevent toner escape around the ends of the developer roller 27, end seals may be employed, such as those described in U.S. Pat. No. 6,487,383, entitled "Dynamic End-Seal for Toner Development Unit," which is incorporated herein by reference.

The photoconductor 22 next rotates past an adjacently-positioned intermediate transfer medium ("ITM"), such as belt 34, to which the toner is transferred from the photoconductor 22. The location of this transfer from the photoconductor 22 to the ITM belt 34 is called the first transfer point (denoted X in FIG. 1). After depositing the toner on the ITM belt 34, the photoconductor 22 rotates through the cleaning section 28 where residual toner is removed from the surface of the photoconductor 22, such as via a cleaning blade well known in the art. The residual toner may be moved along the length of the photoconductor 22 to a waste toner reservoir (not shown) where it is stored until the cartridge 20 is removed from the printer 10 for disposal. The photoconductor 22 may further pass through a discharge area (not shown) having a lamp or other light source for exposing the entire photoconductor surface to light to remove any residual charge and image pattern formed by the laser 32.

As illustrated in FIG. 1, the ITM belt 34 is endless and extends around a series of rollers adjacent to the photoconductors 22 of the various cartridges 20. The ITM belt 34 and each photoconductor 22 are synchronized by controller 12, via gears and the like well known in the art, so as to allow the toner from each cartridge 20 to precisely align on the ITM belt 34 during a single pass. By way of example as viewed in FIG. 1, the yellow toner will be placed on the ITM belt 34, followed by cyan, magenta, and black. The purpose of the ITM belt 34 is to gather the image from the cartridges 20 and transport it to the sheet 5 to be printed on.

The paper 5 may be stored in paper supply tray 14 and supplied, via a suitable series of rollers, belts (vacuum or otherwise), and the like, along a media supply path to the location where the sheet 5 contacts the ITM belt 34. At this location, called the second transfer point (denoted Z in FIG. 1), the toner image on the ITM belt 34 is transferred to the sheet 5. If desired, the sheet 5 may receive an electrostatic charge prior to contact with the ITM belt 34 to assist in attracting the toner from the ITM belt 34. The sheet 5 and attached toner next travel through a fuser 38, typically a pair of rollers with an associated heating element, that heats and fuses the toner to the sheet 5. The paper 5 with the fused image is then transported out of the printer 10 for receipt by a user. After rotating past the second transfer point Z, the ITM belt 34 is cleaned of residual toner by an ITM cleaning assembly 36 so that the ITM belt 34 is clean again when it next approaches the first transfer point X.

Figure 2:
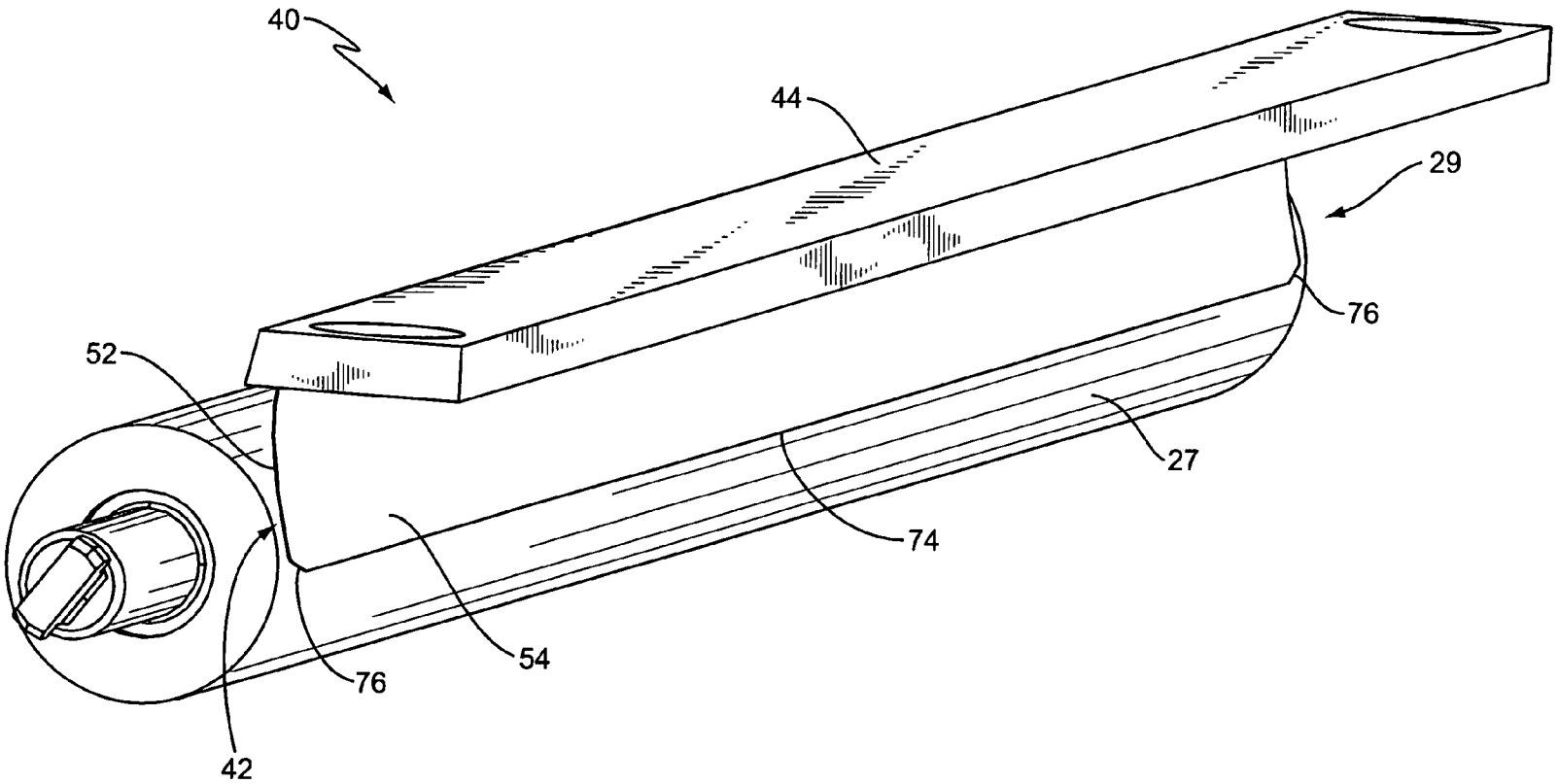
FIG. 2 shows perspective view of a doctor blade according to one embodiment of the present invention pressing against with a doctor blade.

The present invention relates to a toner regulating system 40 that may be employed in electrophotographic imaging devices, such as the printer 10 described above. The illustrative toner regulating system 40 includes the developer roller 27 and the doctor blade 29. Referring to FIG. 2, the doctor blade 29 is supported from the frame of the toner cartridge 20 on one end and presses against the developer roller 27 towards the other end. The pressing of the doctor blade 29 against the developer roller 27 with toner in-between helps regulate the toner, such as by controlling the thickness and charge level on the toner.

Figure 3:
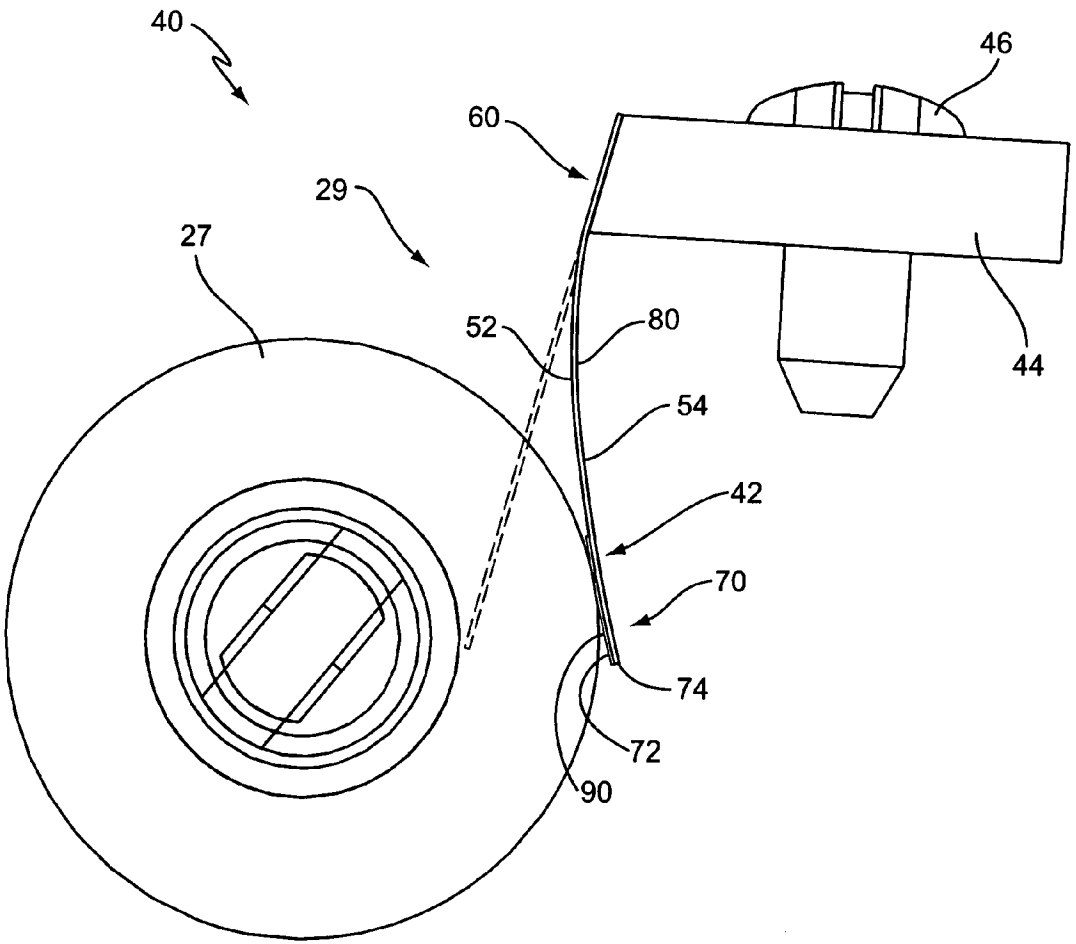
FIG. 3 shows a side view of the components of FIG. 2.

The doctor blade 29 has a generally rectangular form and may be conceptually divided into a mounting portion 60 and a nip portion 70. The mounting portion 60 of the doctor blade 29 mounts to the frame of the cartridge 20, either directly or via a suitable bracket 44. Such a bracket 44, if used, may have a simple bar-like shape and be secured to the frame of the cartridge 20 by suitable fasteners 46. Alternatively, the bracket 44 may have a curved or bowed shape, such as that shown in U.S. Pat. No. 5,489,974, or any other shape known in the art. Further, as shown in the figures, the mounting portion 60 may be advantageously mounted at an angle either toward or away from the center of the developer roller 27. For example, if a bracket 44 is used, the front face of the bracket 44 may be angled, such as a slight forward slant of 12.5° as shown in FIG. 3. The mounting portion 60 of the doctor blade 29 is advantageously mated to some structure (e.g., bracket 44) along its entire lateral length, so as to prevent toner or other debris from becoming trapped between the mounting portion 60 and its supporting structure. The mounting of the mounting portion 60 may be via any known method, such as by a plurality of spot welds, adhesives, or over-molding the support structure around the relevant end of the doctor blade 29. For the embodiment shown in the figures, the mounting portion 60 is mounted at a point downstream from the nip 42 formed between the developer roller 27 and the doctor blade 29. Thus, the doctor blade 29 is in what is commonly referred to as a "counter" (or sometimes "skiving" or "leading") orientation.

Figure 4:
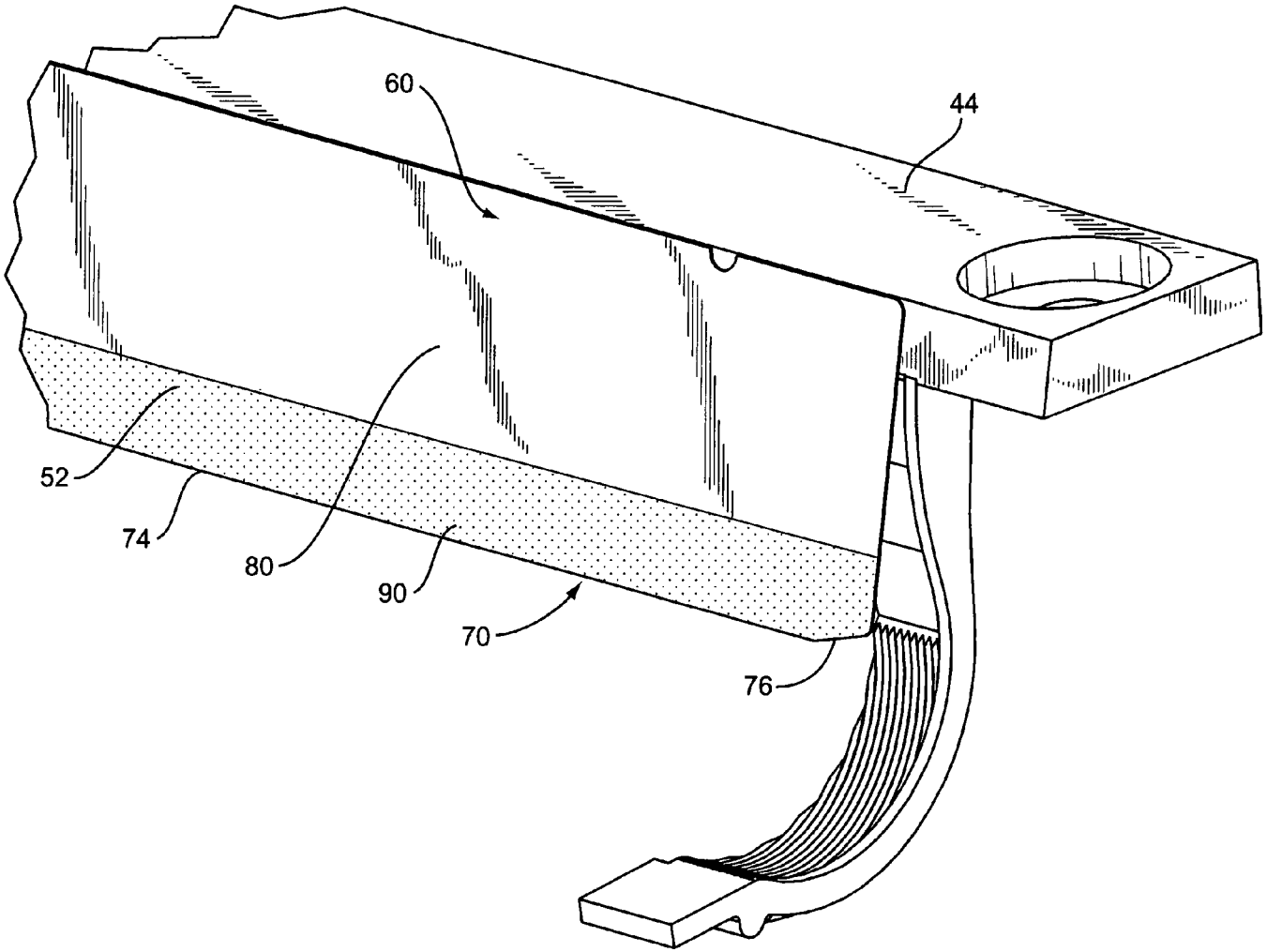
FIG. 4 shows another perspective view of the doctor blade of FIG. 2 with the developer roller removed and an end seal added.

The nip portion 70 of the doctor blade 29 is supported by the mounting portion 60 in a cantilever fashion. That is, the nip portion 70 is not affixed to another portion of the frame, but is instead supported from the frame by the mounting portion 60. The nip portion 70 includes a portion that forms the nip 42 with the developer roller 27 and an optional overhang portion 72 that extends beyond the nip 42. Due to the flexibility of the doctor blade 29, the nip portion 70 presses against the developer roller 27 due to its inherent spring force. This is represented in FIG. 3 where the un-deflected free state of the doctor blade 29 is shown in phantom lines, and the in-use deflected state of the doctor blade 29 is shown in solid lines. Further, as shown in the figures, the nip portion 70 typically presses against the developer roller 27 in such a fashion that the doctor blade 29 is generally tangent to the developer roller 27 at the nip 42. The doctor blade 29 may press against the developer roller 27 with any suitable amount of force per unit length, such as approximately 0.08–0.09 N/mm; note also that this pressing force need not be uniform across the lateral width of the developer roller, such as by using a curved bracket 44, or causing the doctor blade to have a lateral bow (see U.S. Pat. No. 5,485,254), or by any other means known in the art. Note further that because the developer roller 27 has a compressible surface, the pressing of the doctor blade 29 causes the nip 42 formed therebetween to be a small area rather than a simple point (when viewed from the side). The nip 42 may advantageously have a length along the doctor blade 29 of 0.6 mm to 1.2 mm. The distance from the center of this nip 42 to the end 74 of the blade 29, defining the overhang area 72, may be on the order of 0.25 mm to 2 mm, and advantageously approximately 1.3 mm. The distal tip 74 of the doctor blade 29 may have a simple straight profile, or may include a bend or bends, a forward facing chamfer, or any other shape known in the art. The lateral edges of the nip portion 70 may also be relatively straight, or may have any other shape known in the art. For example, the lateral leading edges of the doctor blade 29 may advantageously include chamfers 76, such as 15° by three millimeter chamfers 76 shown in FIG. 4.

As described above, the doctor blade 29 shown in the foregoing Figures is disposed in what is commonly referred to as a "counter" orientation in that the moveable tip 74 of the doctor blade 29 at or near the nip 42 is disposed upstream of the mounting portion 60 of the doctor blade 29, with respect to the direction of the rotation of the developer roller 27. For some embodiments of the present invention, the doctor blade 29 may instead be oriented in a following (or "trailing") orientation, where the nip portion 70 is disposed downstream from the mounting portion 60. Further, the mounting method employed to mount the doctor blade 29 may advantageously allow for a bias voltage to be applied to the doctor blade 29 to assist in controlling toner charge for the residual toner on the developer roller 27. The particular characteristics of the applied bias voltage, if any, are not important to understanding the present invention, and any approach known in the art may be employed.

Figure 5:
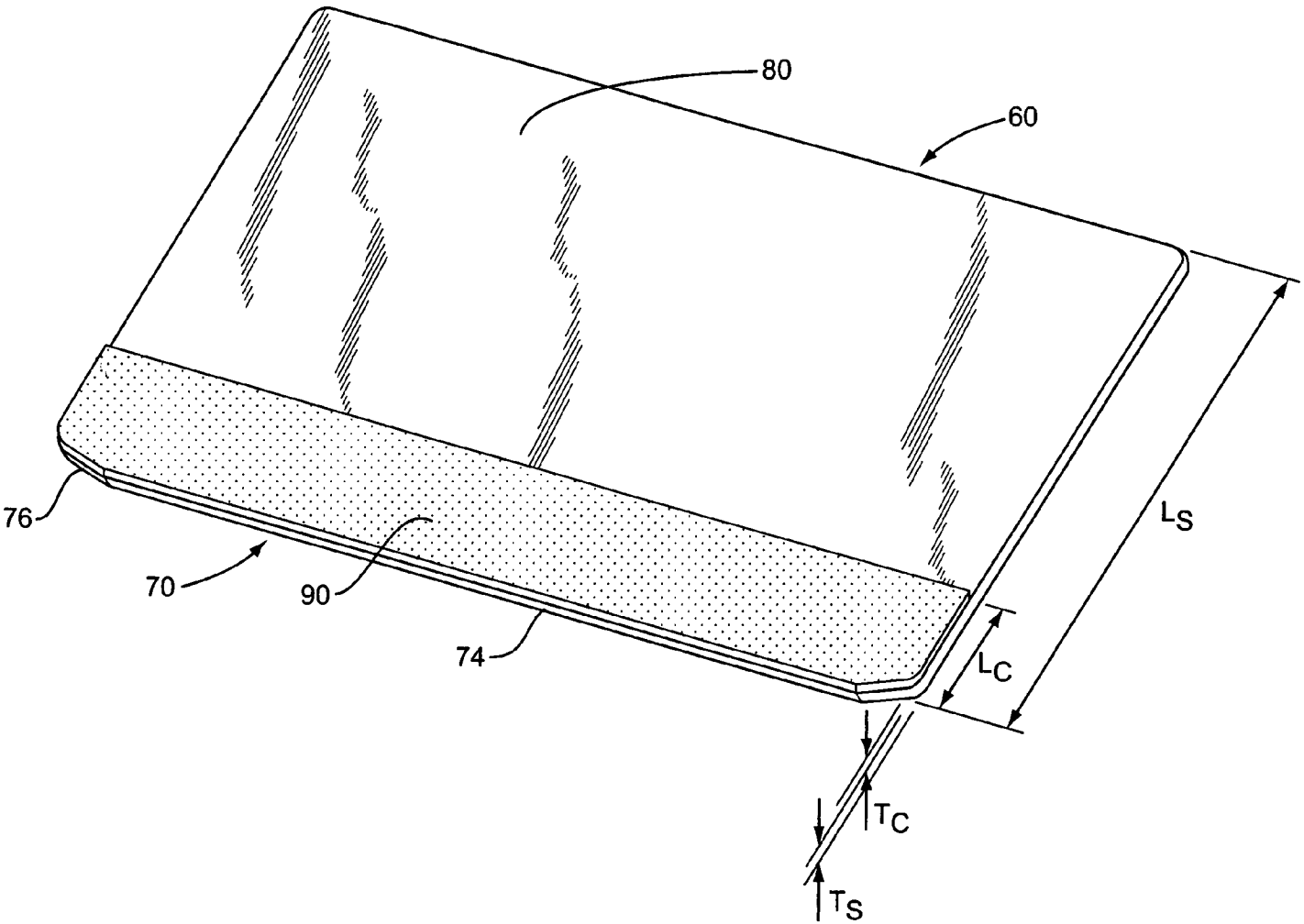
FIG. 5 shows a perspective view of the doctor blade of FIG. 2.

Referring to FIG. 5, the doctor blade 29 includes a substrate 80 and a coating 90. The substrate 80 forms the majority of the doctor blade 29 and typically takes the form of thin, generally rectangular, plate-like member made from a flexible metallic material. For example, the substrate 80 may be formed from a phosphor-bronze "shim" material with a thickness Ts of a nominally 0.025 mm to 0.20 mm, advantageously approximately 0.076 mm, and a length Ls of nominally 12 mm. Such a substrate 80 material has a substantial inherent flexibility that allows it to be deflected a substantial amount and spring back with little to no permanent deformation. The metallic material of the substrate 80 is highly conductive and resilient, such as can be achieved by making the substrate 80 from thin phosphor-bronze, beryllium-copper, stainless steel, and the like. The conductivity may be advantageous in some situations, so as to allow for the bias voltage differential between the doctor blade 29 and the developer roller 27 discussed above to be readily controlled, thereby allowing the charge level on the residual toner on the developer roller 27 after the nip 42 to be properly controlled. The preferred level of this induced charging (if any, and sometimes referred to as charge injection), which is typically combined with the triboelectric charging associated with the nip 42, will depend on the particular application, as is understood by those of skill in such art. In addition to electrical conductivity, metallic materials offer high thermal conductivity, which allows the substrate 80 to aid in pulling heat away from the area of the nip 42 so as to lessen the potential for melting the toner. For ease of reference, the surface of the substrate 80 facing the developer roller 27 will be referred to as the front side 52, with the opposite surface of the substrate 80—facing away from the developer roller 27—referred to as the back side 54. It should be noted that while the substrate 80 may be of a non-homogenous and/or multi-layer construction, the present discussion assumes a homogenous single-layer construction for simplicity.

The coating 90 of the doctor blade 29 is disposed on at least the front side 52 of the substrate 80 in the area of the nip 42. For instance, the coating 90 may be disposed over an area extending from a point near the tip 74 of the substrate 80 to a point on the other side of the nip 42 (towards the mounting portion 60). The length Lc of coating 90 may be, for example, approximately four millimeters. The thickness Tc of the coating 90 may be in the range of approximately 150 um or less, advantageously approximately 25 um or less, and more advantageously be in the range of five microns to fifteen microns.

The coating 90 consists of at least a matrix of a base polymer 92 and a plurality of fine particles 94. The base polymer 92 may be a suitable material, such as polyurethane, polyester, polyamide, epoxides, phenolics, polyimides, and combinations thereof. A number of fine particles 94 are mixed in with the base polymer 92. The fine particles 94 may be one or more materials selected from the group consisting of silicon dioxide, titanium dioxide, cerium oxide, silicon carbide, aluminum oxide, titanium diboride, diamond, borosilicate glass, soda glass, enameled glass, polyurethane beads, polyacrylate beads, and silicone beads, all with a particle size of 0.1 microns to thirty microns, advantageously in the range of about 0.5 microns to about ten microns. The presence of the fine particles 94 has the effect of changing the surface topography of the resulting coating 90 from a relatively smooth topography that would result from using the base polymer 92 without the fine particles 94 to a relatively rougher topography with the fine particles 94 added to the base polymer 92. Thus, the presence of the fine particles 94 alters the topography of the surface of the doctor blade 29 forming the nip 42 with the developer roller 27. The resulting coating 90 advantageously has a surface roughness in the range of 0.15 um to 1.5 um Ra, advantageously in the range of 0.3 to 0.8 um Ra, and 1 to 15 microns Rz, advantageously in the range of two to eight microns Rz, measured using a contact profilometer. It should be noted that the material of the coating 90 should have suitable abrasion resistance properties so as be able have a sufficient operating life, such as twelve thousand pages or more, depending on the application. Further, it should be noted that the use of the term "matrix" with relation to the coating 90, as used herein, does not require that the base polymer 92 and the fine particles 94 of the coating 90 be strictly regularly ordered, but instead is used merely to articulate the idea that the fine 94 particles are substantially embedded in a uniformly or non-uniformly distributed fashion in the base polymer 92.

The mixture 92,94 forming the coating may advantageously have a dry concentration of the fine particles 94 of approximately 1% to 50%, advantageously approximately 10% to 50%, and a wet concentration of approximately 1% to 25%, advantageously approximately 5% to 25%, both on a weight basis. While not required for all embodiments, the mixture 92,94 may include one or more electrically conductive additives, such as carbon black, carbon nanotubes, ionic salts, polyanilines, or metallic particles. The mixture 92,94 forming the coating 90 may, for instance, be made from the materials presented in the table of FIG. 7; of course, other compositions may alternatively be used. The mixture 92,94 may be applied directly to the substrate 80 by any suitable method, such as by dipping, spraying, or otherwise applying the slurry of the mixture 92,94 in any fashion known in the art of coating application. When the coating 90 is dry, the coating 90 may advantageously have an electrical resistivity of not more than $10^9$ Ohm-cm.

Alternatively, in some embodiments, the mixture 92,94 may be applied to an optional suitable adhesive backed carrier stratum 96, such as a polyester film, with the coated carrier stratum 96 applied to the substrate 80 once the coating 90 is dry, so that the coating 90 is facing away from the substrate 80. If the approach of a coated carrier stratum 96 is employed, it may be advantageous to employ an electrically conductive adhesive or an electrically conductive caulk, such as liquid plastic colorant LE-81439 available from American Color, Inc. of Sandusky, Ohio. For example, applying such an electrically conductive adhesive/caulk to the substrate 80 in an area just outside the carrier stratum 96 but touching coating 90 advantageously results in electrically connecting the substrate 80 and the coating 90, thereby bridging what might otherwise be an electrically non-conductive carrier stratum 96. Similar to the above, the coating 90 may be applied to the carrier stratum 96 by any suitable method, such as by dipping, spraying, or otherwise applying the slurry of the mixture 92,94 in any fashion known in the art of coating application.

Figure 6:
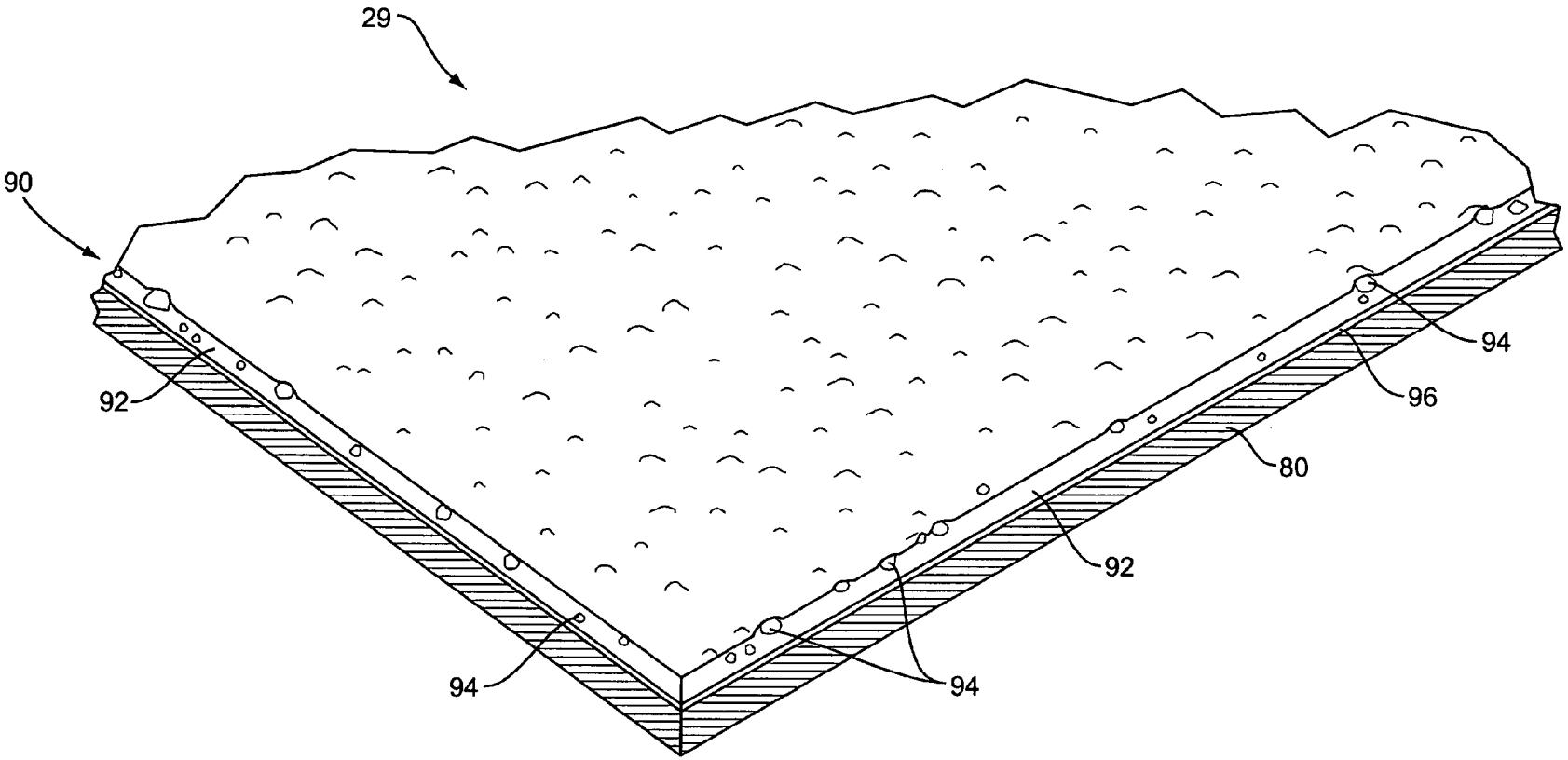
FIG. 6 shows an arbitrary cross-sectional view of the doctor blade of FIG. 5 in an area having coating.
Figure 8:
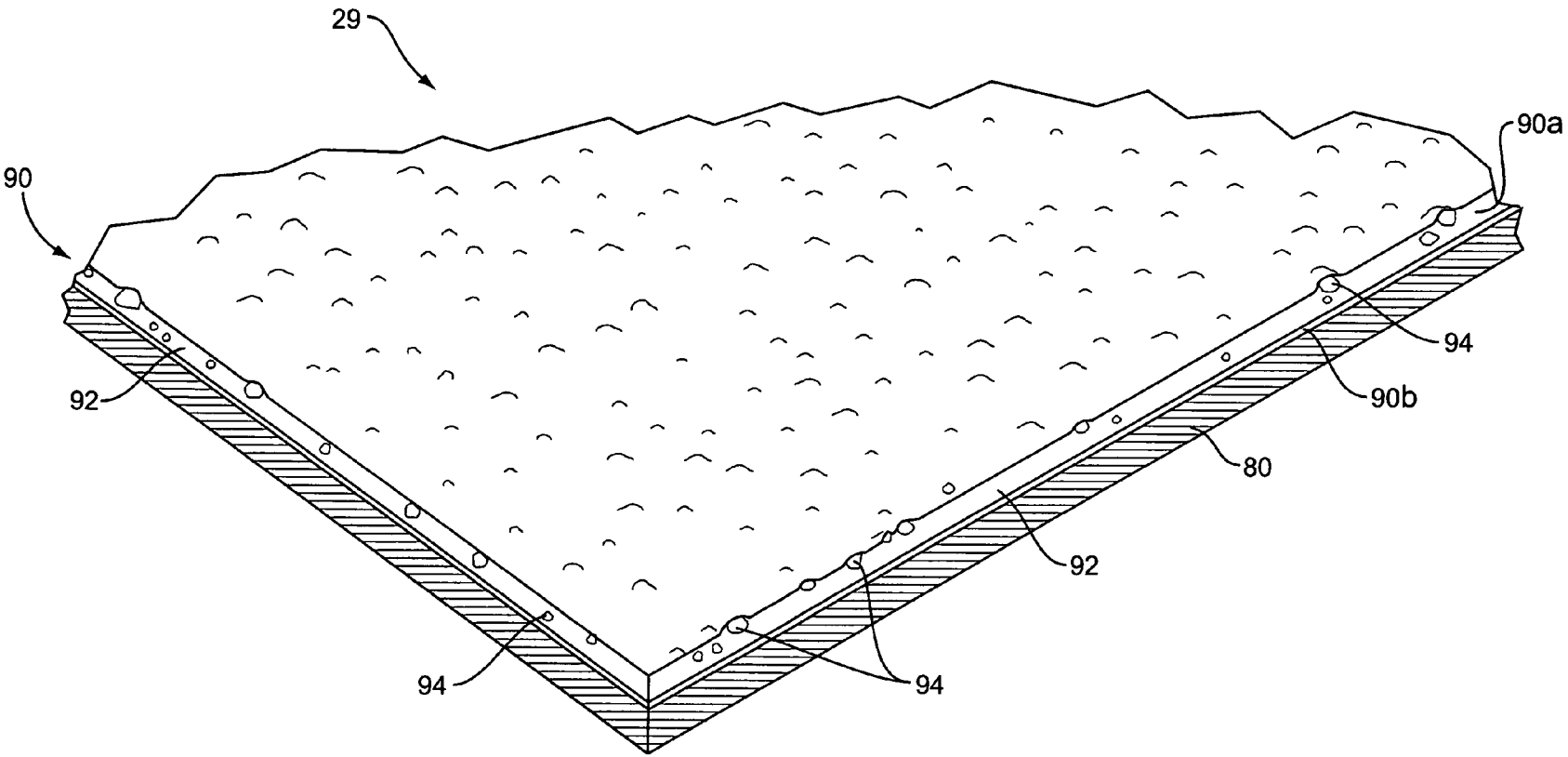
FIG. 8 shows an arbitrary cross-sectional view of an embodiment the doctor blade without a carrier stratum, in an area having coating showing a multiple layer coating.

The coating 90 may consist of only a single layer, or may consist of a plurality of layers (e.g., two, three, or more layers). For example, the coating 90 shown in FIG. 6 is a single layer on a carrier stratum 96, while the coating 90 shown in FIG. 8 is a two layer structure without the carrier stratum 96. The coating of FIG. 8 has an outer layer 90*a* and at least one inner layer 90*b*. For such an arrangement, the fine particles 94 may be present in the outer layer 90*a* only, the inner layer 90*b* only, or in both the outer layer 90*a* and the inner layer 90*b*. Advantageously, the base polymer 92 of the layers 90*a*,90*b* is the same, but the inner layer 90*b* may have suitable additives to enhance the bonding of the inner layer(s) 90*b* to the substrate 80 or carrier stratum 96.

The doctor blade 29 described above may be used in a toner regulating system 40 to help regulate the amount of toner on the developer roller 27. In the illustrative toner regulating system 40, a doctor blade 29 as described above is mounted to a frame of the cartridge 20 along its mounting portion 60, and presses against the developer roller 27 at its nip portion 70 to form a nip 42. The formed nip 42 helps regulate the thickness of the residual toner left on the developer roller 27, and also advantageously applies a triboelectric and/or induced charge on the residual toner. Thus, as suitably thick and charged layer of toner may be formed on the developer roller 27 and carried to the developing location. Just by way of non-limiting example, the residual toner may have a thickness in the range of 4 um to 20 um, for a density of 0.3 to 1.2 mg/cm$^2$, and a charge of −12 uC/gm to −35 uC/gm. Such a toner regulating system 40 may be used with toner that is mono-component or multi-component, magnetic or non-magnetic, color or black, or any other toner used in electrophotographic systems.

The discussion above has been in the context of a conventional multi-color laser printer 10 that employs an intermediate transfer medium 34 for illustrative purposes; however, it should be noted that the present invention is not so limited and may be used in any electrophotographic system, including laser printers, copiers, and the like, with or without intermediate transfer medium 34. Thus, for instance, the present invention may be used in "direct transfer" image forming devices. Further, the illustrative discussion above has been used a developer roller 27 and the relevant toner carrier, but the present is invention is not limited to use with developer rollers 27, and may be used to regulate the thickness and/or charge on developer belts or any other developer carrier.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner layer regulating system for an electrophotographic image forming apparatus, comprising:

a toner carrier;

a toner regulating member supported in cantilevered fashion against said toner carrier so as to form a toner nip therebetween; said toner regulating member comprising a flexible metallic substrate having a first surface disposed toward said toner carrier and a coating covering at least an area of said first surface forming said nip;

wherein said coating comprises a matrix of a base polymer and a plurality of fine particles, said fine particles having a particle size of 0.1 microns to thirty microns; wherein said coating has a thickness of approximately one hundred fifty microns or less;

wherein said coating has a surface roughness in the range of 0.15 to 1.5 microns Ra and in the range of 1 to 15 microns Rz.

2. The toner regulating system of claim 1 wherein said fine particles are selected from the group consisting of silicon dioxide, titanium dioxide, cerium oxide, silicon carbide, aluminum oxide, titanium diboride, diamond, borosilicate glass, soda glass, enameled glass, polyurethane beads, polyacrylate beads, and silicone beads.

3. The toner regulating system of claim 2 wherein said coating has a dry concentration of said fine particles of between about 1% and about 50% of said coating on a weight basis.

4. The toner regulating system of claim 3 wherein said coating is formed from a mixture having a wet concentration of said fine particles of between about 1% and about 25% on a weight basis.

5. The toner regulating system of claim 1 wherein said base polymer is selected from a group consisting of polyurethane, polyester, polyamide, epoxides, phenolics, polyimides, and combinations thereof.

6. The toner regulating system of claim 1 wherein said coating further comprises a conductive additive selected from the group consisting of an ionic salt, carbon nanotubes, carbon black, polyanilines, and metallic particles.

7. The toner regulating system of claim 1 wherein said toner regulating member further comprises a carrier stratum disposed between said coating and said substrate.

8. The toner regulating system of claim 7 wherein said carrier stratum adhesively secures to said substrate.

9. The toner regulating member of claim 7 wherein said toner regulating member further comprises a conductive caulk electrically connecting said coating to said substrate.

10. The toner regulating system of claim 1 wherein said coating has a thickness of twenty-five microns or less.

11. The toner regulating system of claim 1 wherein substantially all of said fine particles in said coating have a particle size of 0.5 microns to ten microns.

12. The toner regulating member of claim 1 wherein said coating has an electrical resistivity of $\leqq 10^9$ Ohm-cm.

13. The toner regulating system of claim 1 wherein said coating comprises a plurality of layers including an outer layer and a second layer disposed between said outer layer and said substrate, wherein said fine particles are present in at least one of said outer and said second layers.

14. The toner regulating system of claim 13 wherein said fine particles are present in not more than one of said outer and said second layers.

15. The toner regulating system of claim 1 wherein said base polymer is selected from a group consisting of polyurethane, polyester, polyamide, epoxides, phenolics, polyimides, and combinations thereof;

wherein said fine particles are selected from the group consisting of silicon dioxide, titanium dioxide, cerium oxide, silicon carbide, aluminum oxide, titanium diboride, diamond, borosilicate glass, soda glass, enameled glass, polyurethane beads, polyacrylate beads, and silicone beads;

wherein said coating has a dry concentration of said fine particles of between about 10% and about 50% of said coating on a weight basis;

wherein said coating is formed from a mixture having a wet concentration of said fine particles of between about 5% and about 25% on a weight basis; and wherein said coating has an electrical resistivity of $\leqq 10^9$ Ohm-cm.

16. A toner cartridge, comprising:

a housing;

a toner carrier rotatably supported by said housing;

a toner regulating member disposed proximate said toner carrier and supported in cantilevered fashion against said toner carrier so as to form a toner nip therebetween; said toner regulating member comprising a flexible metallic substrate having a first surface disposed toward said toner carrier and a coating covering at least an area of said first surface forming said nip;

wherein said coating comprises a matrix of a base polymer resin and a plurality of fine particles having a particle size of 0.1 microns to thirty microns; wherein said coating has a thickness of approximately one hundred fifty microns or less; and wherein said coating has a surface roughness in the range of 0.15 to 1.5 microns Ra and in the range of 1 to 15 microns Rz.

17. The toner cartridge of claim 16 wherein said fine particles are selected from the group consisting of silicon dioxide, titanium dioxide, cerium oxide, silicon carbide, aluminum oxide, titanium diboride, diamond, borosilicate glass, soda glass, enameled glass, polyurethane beads, polyacrylate beads, and silicone beads.

18. The toner cartridge of claim 17 wherein said coating has a dry concentration of said fine particles of between about 1% and about 50% of said coating on a weight basis.

19. The toner cartridge of claim 18 wherein said coating is formed from a mixture having a wet concentration of said fine particles of between about 1% and about 25% on a weight basis.

20. The toner cartridge of claim 16 wherein said base polymer is selected from a group consisting of polyurethane, polyester, polyamide, epoxides, phenolics, polyimides, and combinations thereof.

21. The toner cartridge of claim 16 wherein said coating further comprises a conductive additive selected from the group consisting of an ionic salt, carbon nanotubes, carbon black, polyanilines, and metallic particles.

22. The toner cartridge of claim 16 wherein said toner regulating member further comprises a carrier stratum disposed between said coating and said substrate.

23. The toner cartridge of claim 22 wherein said carrier stratum adhesively secures to said substrate.

24. The toner cartridge of claim 22 wherein said toner regulating member further comprises a conductive caulk electrically connecting said coating to said substrate.

25. The toner cartridge of claim 16 wherein said coating has a thickness of twenty-five microns or less.

26. The toner cartridge of claim 16 wherein substantially all of said fine particles in said coating have a particle size of 0.5 microns to ten microns.

27. The toner cartridge of claim 16 wherein said coating has an electrical resistivity of $\leqq 10^9$ Ohm-cm.

28. The toner cartridge of claim 16 wherein said coating comprises a plurality of layers including an outer layer and a second layer disposed between said outer layer and said substrate, wherein said fine particles are present in at least one of said outer and said second layers.

29. The toner cartridge of claim 28 wherein said fine particles are present in not more than one of said outer and said second layers.

30. The toner cartridge of claim 16 wherein said base polymer is selected from a group consisting of polyurethane, polyester, polyamide, epoxides, phenolics, polyimides, and combinations thereof;

wherein said fine particles are selected from the group consisting of silicon dioxide, titanium dioxide, cerium oxide, silicon carbide, aluminum oxide, titanium diboride, diamond, borosilicate glass, soda glass, enameled glass, polyurethane beads, polyacrylate beads, and silicone beads; substantially all of said fine particles in said coating having a particle size of 0.5 microns to ten microns;

wherein said mixture has a dry concentration of said fine particles of between about 10% and about 50% of said coating on a weight basis; and wherein said coating is formed from a mixture having a wet concentration of said fine particles of between about 5% and about 25% on a weight basis; and wherein said coating has an electrical resistivity of $\leqq 10^9$ Ohm-cm.

31. An image forming device, comprising:

a supply source for media;

at least one toner cartridge supplying a toner image for transfer to said media, said toner cartridge comprising:

a housing;

a toner carrier rotatably supported by said housing;

a toner regulating member disposed proximate said toner carrier and supported in cantilevered fashion against said toner carrier so as to form a toner nip therebetween; said toner regulating member comprising a flexible metallic substrate having a first surface disposed toward said toner carrier and a coating covering at least an area of said first surface forming said nip;

wherein said coating comprises at least matrix of a base polymer resin and a plurality of fine particles having a particle size of 0.1 microns to thirty microns; wherein said coating has a thickness of approximately one hundred fifty microns or less; and wherein said coating has a surface roughness in the range of 0.15 to 1.5 microns Ra and in the range of 1 to 15 microns Rz.

32. The image forming device of claim 31 wherein said fine particles are selected from the group consisting of silicon dioxide, titanium dioxide, cerium oxide, silicon carbide, aluminum oxide, titanium diboride, diamond, borosilicate glass, soda glass, enameled glass, polyurethane beads, polyacrylate beads, and silicone beads.

33. The image forming device of claim 32 wherein said coating has a dry concentration of said fine particles of between about 1% and about 50% of said coating on a weight basis.

34. The image forming device of claim 33 wherein said coating is formed from a mixture having a wet concentration of said fine particles of between about 1% and about 25% on a weight basis.

35. The image forming device of claim 31 wherein said base polymer is selected from a group consisting of polyurethane, polyester, polyamide, epoxides, phenolics, polyimides, and combinations thereof.

36. The image forming device of claim 31 wherein said coating further comprises a conductive additive selected from the group consisting of an ionic salt, carbon nanotubes, carbon black, polyanilines, and metallic particles.

37. The image forming device of claim 31 wherein said toner regulating member further comprises a carrier stratum disposed between said coating and said substrate.

38. The image forming device of claim 37 wherein said carrier stratum adhesively secures to said substrate.

39. The image forming device of claim 37 wherein said toner regulating member further comprises a conductive caulk electrically connecting said coating to said substrate.

40. The image forming device of claim 31 wherein said coating has a thickness of twenty-five microns or less.

41. The image forming device of claim 31 wherein substantially all of said fine particles in said coating have a particle size of 0.5 microns to ten microns.

42. The image forming device of claim 31 wherein said coating has an electrical resistivity of $\leqq 10^9$ Ohm-cm.

43. The image forming device of claim 31 wherein said coating comprises a plurality of layers including an outer layer and a second layer disposed between said outer layer and said substrate, wherein said fine particles are present in at least one of said outer and said second layers.

44. The image forming device of claim 43 wherein said fine particles are present in not more than one of said outer and said second layers.

45. The image forming device of claim 31 wherein said base polymer is selected from a group consisting of polyurethane, polyester, polyamide, epoxides, phenolics, polyimides, and combinations thereof;

wherein said fine particles are selected from the group consisting of silicon dioxide, titanium dioxide, cerium oxide, silicon carbide, aluminum oxide, titanium diboride, diamond, borosilicate glass, soda glass, enameled glass, polyurethane beads, polyacrylate beads, and silicone beads; substantially all of said fine particles in said coating having a particle size of 0.5 microns to ten microns;

wherein said mixture has a dry concentration of said fine particles of between about 10% and about 50% of said coating on a weight basis; and wherein said coating is formed from a mixture having a wet concentration of said fine particles of between about 5% and about 25% on a weight basis; and wherein said coating has an electrical resistivity of $\leqq 10^9$ Ohm-cm.

* * * * *